US007244016B2

(12) United States Patent
Iwashita et al.

(10) Patent No.: US 7,244,016 B2
(45) Date of Patent: Jul. 17, 2007

(54) INK JET HEAD AND ITS MANUFACTURING METHOD, AND INK JET PRINTER

(75) Inventors: Setsuya Iwashita, Nirasoki (JP); Takamitsu Higuchi, Matsumoto (JP); Hiromu Miyazawa, Toyoshira-machi (JP); Satoshi Nebashi, Shiojiri (JP)

(73) Assignee: Seiko Epson Corporation (JP)

( * ) Notice: Subject to any disclaimer, the term of this patent is extended or adjusted under 35 U.S.C. 154(b) by 242 days.

(21) Appl. No.: 11/002,964

(22) Filed: Dec. 2, 2004

(65) Prior Publication Data

US 2005/0134652 A1 Jun. 23, 2005

(30) Foreign Application Priority Data

Dec. 3, 2003 (JP) ..... 2003-404297

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS 6,183,070 B1 * 2/2001 Hashizume ..... 347/70

FOREIGN PATENT DOCUMENTS

JP 2003-152233 5/2005
JP 2003-152288 5/2005

* cited by examiner

*Primary Examiner*—Stephen Meier
*Assistant Examiner*—Geoffrey S. Mruk
(74) *Attorney, Agent, or Firm*—Harness, Dickey & Pierce, P.L.C.

(57) ABSTRACT

An ink jet head is provided that can effectively suppress operational interferences among adjacent cavities, and is capable of ultra-high-density and high-speed printing. The ink jet head is equipped with a plurality of cavities each having a volume that is variable by a deformation operation of a piezoelectric element, wherein beam members are provided between inner walls that interpose the cavity.

7 Claims, 8 Drawing Sheets

INK JET HEAD AND ITS MANUFACTURING METHOD, AND INK JET PRINTER

RELATED APPLICATIONS

This application claims priority to Japanese Patent Application No. 2003-404297 filed Dec. 3, 2003, which is hereby expressly incorporated by reference herein in its entirety.

BACKGROUND

1. Technical Filed

The present invention relates to an ink jet head and its manufacturing method, and an ink jet printer.

2. Related Art

In recent years, the performance of ink jet printers has advanced to levels that can provide a high picture quality equivalent to the picture quality of photographs. This has been achieved by increasing the number of nozzles of an ink jet head and reducing the amount (volume) of a discharged liquid droplet to enable ultra-high-density drawing (printing). Furthermore, in addition to ultra-high-density printing, there are great demands for higher printing speeds. For meeting both demands, the number of nozzles is an important factor and the greater the number of nozzles, the more advantageous the configuration is for higher density and higher speed printing. Among ink jet heads of a system in which the volume of a cavity is changed by a piezoelectric element to jet (eject) a droplet, those with ultra-high-density have 6-8 rows, each of the rows including 80 dpi×2 of nozzles. However, by simply increasing the number of nozzles, the size of the head becomes larger. In this respect, in order to reduce the size of the head and provide nozzles in an ultra-high density, the cavity needs to be made smaller.

FIG. 9 shows a cross-sectional view of a structure of a conventional ink jet head. Reference numeral 210 denotes a nozzle plate, reference numeral 211 denotes nozzles (discharge openings), reference numeral 220 denotes a Si substrate, a reference numeral 230 denotes a vibration plate, and reference numeral 240 denotes piezoelectric elements. Cavities 221 of the recording head are formed through patterning the Si substrate 220 by wet etching or dry etching, which is then bonded with the nozzle plate 210. The height (depth or size) of the cavities 221 and the thickness of each side wall 222 are designed such that the vibration plate 230 has a proper displacement.

However, as the cavities 221 are formed with a higher density for achieving ultra-high-density printing by the ink jet head, the thickness of the side wall 222 inevitably becomes thinner, and as a result, the side wall 222 would likely resiliently deform by the operation of the piezoelectric element 240. Thus, the volume of each of the adjacent cavities 221 changes due to the deformation, and as a result, it becomes difficult to maintain the correct discharge amount, and there is a possibility that the image quality of the printed matter may deteriorate.

The present invention has been made in view of the problems of the conventional technology, and one object is to provide an ink jet head that can effectively suppress operational interferences among adjacent cavities, and is capable of ultra-high-density and high-speed printing, and its manufacturing method. Also, it is an object of the present invention to provide an ink jet printer that is equipped with an ink jet head that is capable of ultra-high-density and high-speed printing.

SUMMARY

In accordance with the present invention, to solve the problems described above, there is provided an ink jet head comprising: a piezoelectric element; and a plurality of cavities, each cavity provided below the piezoelectric element and having a volume that changes according to a deformation of the piezoelectric element, and provided with beam members that connect inner walls of the cavity.

By the ink jet head equipped with the structure above, even when the nozzles are arranged in a higher density and the cavities are made narrower and smaller to achieve ultra-high-density printing, the configuration of the cavities can be well maintained by the beam members that connect the inner walls, such that adjacent cavities can be effectively prevented from interferences of deformations of the walls composing a cavity which might otherwise be caused by the stress of the piezoelectric element. Accordingly, by the present ink jet head, an ink discharge in an ultra-high-definition and at a high speed can be accurately conducted. Also, vibrations of the inner walls that may be caused by vibrations occurring at the time of scanning the head can also be prevented, such that an ink jet head that is capable of stable droplet discharge operation even at the time of high-speed scanning of the head can be provided.

In the ink jet head in accordance with the present invention, the cavity may be a space that is surrounded by a nozzle plate having a droplet discharge opening, a plurality of side walls extending from the nozzle plate and a vibration plate disposed opposite to the nozzle plate, wherein the beam members may span between the side walls disposed mutually opposite to each other.

With the structure described above, the beam members are installed in a direction of the surface of the vibration plate, such that deformations of the side walls in the direction of the surface of the vibration plate can be effectively prevented by the beam members. Accordingly, when the piezoelectric element is operated, movement of the side walls in a direction of the adjacent cavities is suppressed, such that operational interferences among the cavities are substantially prevented. In this way, even when the cavities are made narrower and smaller and their side walls become thinner, an excellent droplet discharge performance can be achieved.

In the ink jet head in accordance with the present invention, the cavity may preferably be formed in a generally rectangular shape in a plan view, and the beam members may preferably span between the side walls opposing in a direction along the short sides of the cavity. With this structure, vibrations of the side walls in the direction of adjacent cavities can be effectively prevented, and operational interferences among the cavities can be prevented.

In the ink jet head in accordance with the present invention, the plurality of beam members may preferably be arranged in parallel with one another in a direction of the long sides of the cavity in a plan view. With this structure, the side walls are reinforced and supported by the plurality of beam members, such that vibrations of the side walls at the time of operation of the piezoelectric elements can be effectively prevented.

In the ink jet head in accordance with the present invention, the beam members and the inner walls of the cavity where the beam members are installed may preferably be formed from an identical material. With this structure, the inner walls surrounding the cavities and the beam members can be formed together (integrally), such that an ink jet head that can be readily and effectively manufactured can be provided.

In the ink jet head in accordance with the present invention, the beam members and the inner walls of the cavity where the beam members are installed may preferably be both formed from a metal material. With this structure, an ink jet head with excellent durability and reliability can be provided.

It the ink jet head in accordance with the present invention, the side walls and the vibration plate may preferably be formed from an identical material. With this structure, the side walls surrounding the cavities and the vibration plate can be formed integrally together, and bonding between the side walls and the vibration plate is excellent as they are composed of the same material, such that an ink jet head that has excellent durability and reliability and can be effectively manufactured can be provided.

Next, a method for manufacturing an ink jet head in accordance with the present invention pertains to a method for manufacturing an ink jet head equipped with a plurality of cavities each having a volume that is varied by a deforming operation of a piezoelectric element, and comprises: a side wall forming step of repeating a step of forming a side wall material layer in a predetermined shape with a first material on a base material and a step of forming a filling layer by embedding a second material different from the first material in a gap in the side wall material layer, thereby laminating the side wall material layer and the filling layer on the base material; and a step of selectively removing the filling layer to form side walls of the cavities on the base material, wherein the side wall forming step includes a step of forming a beam member layer that traverses the filling layer in the gap in the side wall material layer.

According to this manufacturing method, the side wall material layers in a specified plane configuration are laminated to form side walls of the cavities and while the side wall material layers are laminated, the beam member layer can be formed such that an ink jet head in which beam members are formed in the cavities can be readily obtained. According to this manufacturing method, the beam members having optional shape and size can be accurately formed within the cavities of small and narrow spaces, such that an ink jet head that has side walls that resist vibrating at the time of operation and therefore can prevent operational interferences among adjacent cavities can be manufactured. Accordingly, by the present manufacturing method, an ink jet head that is capable of super-high-density printing and high-speed operation can be readily and effectively manufactured.

In the method for manufacturing an ink jet head in accordance with the present invention, the beam member layer may preferably be formed by using the first material continuous in one piece with the side wall material layer. By this manufacturing method, when the side wall material layers are laminated, the beam member layer can be formed at the same time, such that an ink jet head equipped with cavities having the beam members formed therein can be effectively manufactured.

The method for manufacturing an ink jet head in accordance with the present invention can include, after the side wall forming step, a vibration plate forming step of forming a vibration plate by using the first material, which covers the side wall material layer and the filling layer. According to this manufacturing method, by selectively removing the filling layer, an ink jet head having side walls that compose the cavities and the vibration plate that are formed continuously as one piece can be manufactured, and an ink jet head that excels in strength and durability and is capable of super-high-density and stable high-speed operation can be effectively manufactured.

The method for manufacturing an ink jet head in accordance with the present invention can include, after the vibration plate forming step, a piezoelectric element mounting step of bonding the vibration plate and a piezoelectric element. According to this manufacturing method, after the vibration plate layer is formed, the piezoelectric element mounting step is continuously conducted, such that an ink jet head can be effectively manufactured.

In the method for manufacturing an ink jet head in accordance with the present invention, the piezoelectric element mounting can include a step of bonding the piezoelectric element retained on a transfer base material and the vibration plate, and a step of separating the transfer base material from the piezoelectric element after bonding. According to this manufacturing method, the piezoelectric elements that are held by the transfer base material are bonded to the vibration plate. Accordingly, high performance piezoelectric elements, which are prepared independently from members composing the cavities such as the nozzle plate, side walls, vibration plate and the like, can be used, and they can be readily positioned with respect to the vibration plate.

In the method for manufacturing an ink jet head in accordance with the present invention, a step of retaining the piezoelectric element on the transfer base material may preferably include a step of forming the piezoelectric element over a single crystal substrate through a sacrificial layer, and a step of separating the piezoelectric element from the single crystal substrate at the sacrificial layer, after the piezoelectric element and the transfer base material are bonded. According to this method, piezoelectric elements that are formed on a single crystal substrate are retained on a transfer base material, and bonded to the vibration plate. Accordingly, as compared to the case where piezoelectric elements are formed by laminating piezoelectric films or the like on a vibration plate, an ink jet head equipped with high performance piezoelectric elements in which the crystallinity of the piezoelectric films is excellent can be manufactured.

In the method for manufacturing an ink jet head in accordance with the present invention, for separating the transfer base material from the piezoelectric element, heat or light may preferably be irradiated from the side of the transfer base material. According to this manufacturing method, the transfer base material and the piezoelectric elements can be very easily separated, and also can be safely separated without damaging the piezoelectric elements.

In the method for manufacturing an ink jet head in accordance with the present invention, the step of selectively removing the filling layer may preferably be conducted after the piezoelectric element mounting step. This method facilitates the work of mounting the piezoelectric elements, and is excellent in terms of protecting the cavities. In other words, after the cavities are formed by removing the filling layer, the base material having the minute spaces formed therein and the piezoelectric elements are bonded, which may require great attention to bonding pressure and the like. However, in a state in which the filling layer is not removed, deformations of the cavities by external stresses are substantially prevented, and manufacturing becomes facilitated.

In the method for manufacturing an ink jet head in accordance with the present invention, a nozzle plate provided with droplet discharge openings can be used as the base material. According to this manufacturing method, the side walls can be directly formed on the nozzle plate at accurate positions, and the vibration plate may also be manufactured in one step, such that an ink jet head can be very effectively manufactured.

Next, in accordance with the present invention, there is provided an ink jet printer that comprises the ink jet head recited above. Also, the ink jet printer in accordance with the present invention may be equipped with an ink jet head that is obtained by the manufacturing method in accordance with the present invention described above.

Because the ink jet printer is equipped with an ink jet head in accordance with the present invention that is capable of super-high-density and high-speed printing, high quality and high speed printing becomes possible.

DETAILED DESCRIPTION

An ink jet printer, an ink jet head and a method for manufacturing an ink jet head in accordance with embodiments of the present invention are described below with reference to the accompanying drawings. It is noted that the embodiments below do not limit the scope of the present invention.

Ink Jet Printer

An ink jet printer equipped with an ink jet head in accordance with an embodiment of the present invention is described below. It is noted that the present embodiment is described by using a printer that prints characters and images on recording paper or the like as an example. However, the ink jet printer in accordance with the present invention is not limited to embodiments that print on recording paper or the like, but also includes droplet discharging apparatuses that are used in industries (for example, a color filter manufacturing apparatus, an organic EL element manufacturing apparatus, a wiring pattern forming apparatus, and the like).

Figure 1:
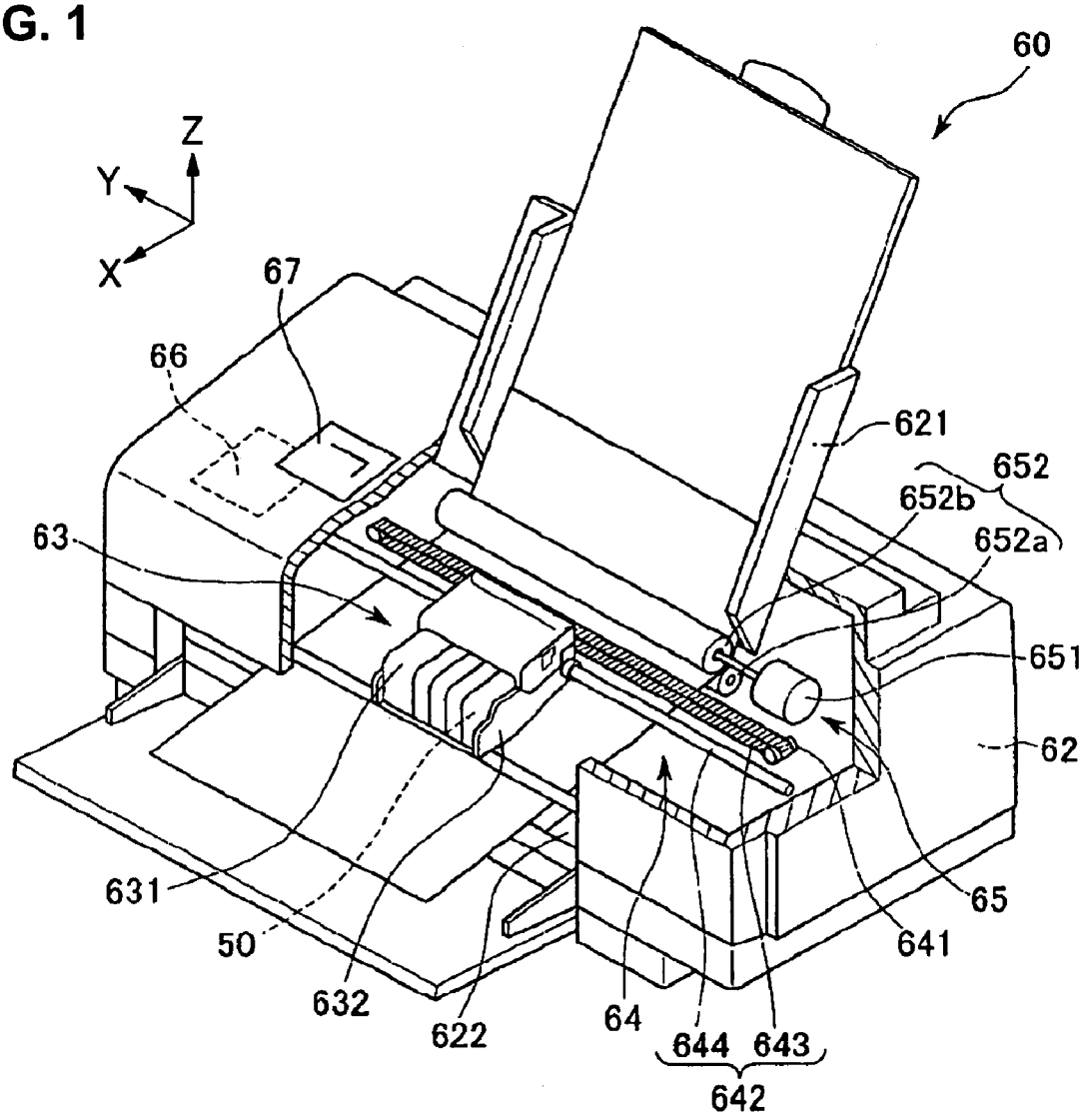
FIG. 1 is a perspective view of a structure of an ink jet printer in accordance with an embodiment.

FIG. 1 is a schematic structural view indicating one example in which an ink jet printer in accordance with the present invention is applied to an ordinary printer that prints on paper or the like, wherein reference numeral 60 in FIG. 1 denotes an ink jet printer. It is noted that, in the following descriptions, an upper side in a Z direction in FIG. 1 refers to an "upper section," and a lower side in the Z direction refers to a "lower side."

The ink jet printer 60 is equipped with an apparatus main body 62, which includes a tray 621 for holding recording paper in an upper rear section thereof, a discharge port 622 for discharging the recording paper to a lower front section thereof, and an operation panel 67 on an upper surface thereof.

The operation panel 67 is formed from a display device, such as, for example, a liquid crystal display, an organic EL display, or an LED lamp, and is equipped with a display section (not shown) for displaying error messages and the like, and an operation section (not shown) composed of various switches and the like.

Also, the apparatus main body 62 is mainly provided on the inside with a printing device 64 equipped with a head unit 63 that can reciprocate, a paper feeding device 65 for feeding recording paper one by one into the printing device 64, and a control section 66 for controlling the printing device 64 and the paper feeding device 65.

By the control of the control section 66, the paper feeding device 65 intermittently feeds the recording paper one by one. The recording paper intermittently fed passes near a lower section of the head unit 63. In this moment, the head unit 63 reciprocally moves in a direction generally perpendicular to a feeding direction of the recording paper, and prints on the recording paper. In other words, the reciprocal movement of the head unit 63 and the intermittent feeding of the recording paper define a main scanning and an auxiliary scanning, respectively, thereby performing printing by an ink jet method.

The printing device 64 is equipped with the head unit 63, a carriage motor 641 that is a driving source for the head unit 63, and a reciprocation mechanism 642 that receives rotations of the carriage motor 641 to reciprocate the head unit 63.

The head unit 63 includes the ink jet recording head 50 equipped with multiple nozzles in its lower section, ink cartridges 631 that supply ink to the ink jet recording head 50, and a carriage 632 on which the ink jet recording head 50 and the ink cartridges 631 are mounted.

It is noted that the ink cartridges 631 that are filled with four colors of yellow, cyan, magenta and black may be used, to enable full-color printing. In this case, the head unit 63 may be provided with the ink jet recording heads 50 corresponding to the respective colors.

The reciprocation mechanism 642 includes a carriage guide shaft 644 having both ends thereof supported by a frame (not shown), and a timing belt 643 that extends in parallel with the carriage guide shaft 644 and is capable of traveling operation. The carriage 632 is freely reciprocally supported by the carriage guide shaft 644, and affixed to a portion of the timing belt 643.

By operation of the carriage motor 641, the timing belt 643 is moved in a positive or reverse direction through pulleys, and the head unit 63 is guided by the carriage guide shaft 644 and reciprocally moves. During these reciprocal movements, the ink is appropriately jetted from the ink jet recording head 50, thereby printing on the recording paper.

The paper feeding device 65 includes a paper feeding motor 651 that servers a driving source thereof and a paper feeding roller 652 that is rotated by operations of the paper feeding motor 651.

The paper feeding roller 652 is composed of a follower roller 652*a* and a driving roller 652*b* which are disposed up and down and opposite each other with a feeding path of the recording paper being interposed between them, and the driving roller 652*b* is coupled to the paper feeding motor 651. By this structure, the paper feeding roller 652 can feed multiple sheets of recording paper disposed in the tray 621 one by one, toward the printing device 64. It is noted that, instead of the tray 621, a paper feeding cassette for storing recording paper may be mounted in a freely detachable manner.

The control section 66 controls printing operations by driving the printing device 64, the paper feeding device 65 and the like based on print data inputted from a host computer, such as, for example, a personal computer, digital camera, and the like. The control section 66 is equipped mainly with a memory that stores control programs and the like to control the respective sections, a head driving circuit that drives the ink jet head 50 and controls ink jetting timing, a control circuit that drives the printing device 64 (carriage motor 641), a driving circuit that drives the paper feeding device 65 (paper feeding motor 651), a communication circuit that obtains printing data from a host computer, and a CPU that is electrically connected to these circuits, and performs various controls at each of the sections, although none of them are illustrated.

Also, the CPU is electrically connected to various kinds of sensors that can detect the amount of ink remaining in the ink cartridges 631, and the printing environment such as the position, temperature, humidity and the like of the head unit 63. The control section 66 obtains printing data through the communication circuit, and stores the same in the memory. The CPU processes the printing data, and outputs driving signals to the corresponding driving circuits based on the processed data and input data from the variety of sensors. Based on the driving signals, the ink jet head 50, the printing device 64 and the paper feeding device 65 are operated. In this way, desired printing is performed on the recording paper.

Ink Jet Head

Overall Structure

Figure 2:
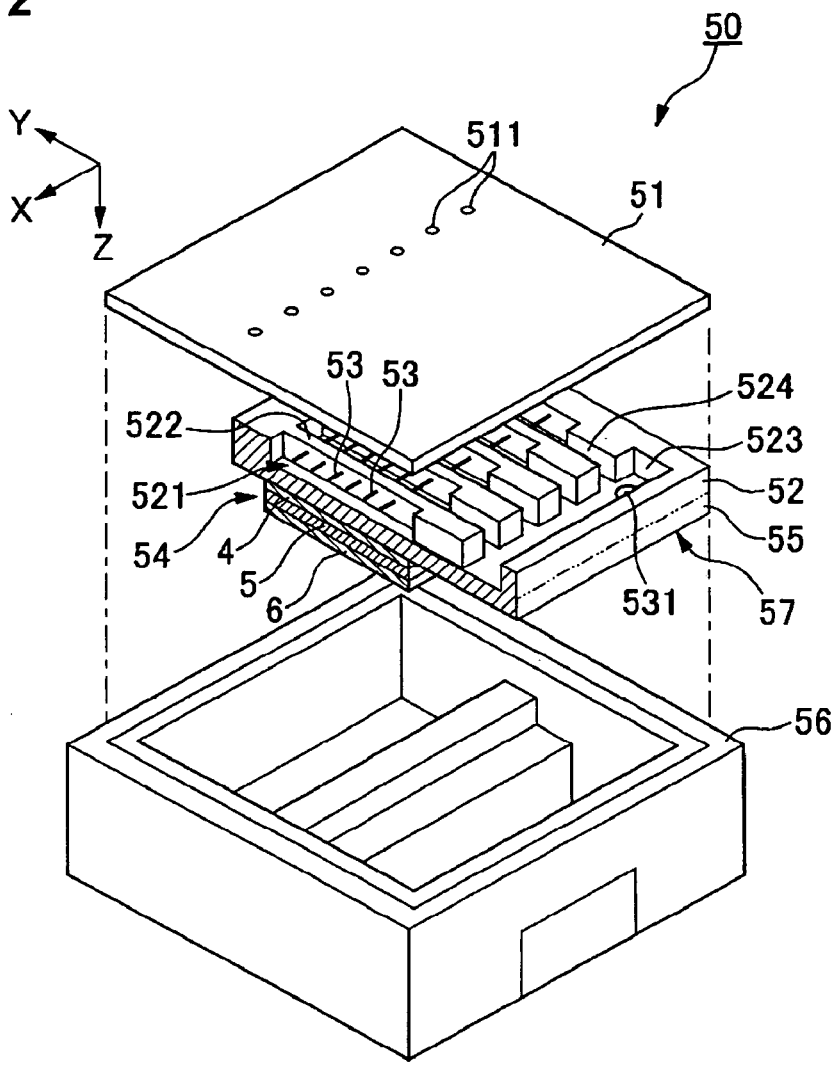
FIG. 2 is an exploded perspective view of a structure of an ink jet head in accordance with the embodiment.
Figure 3:
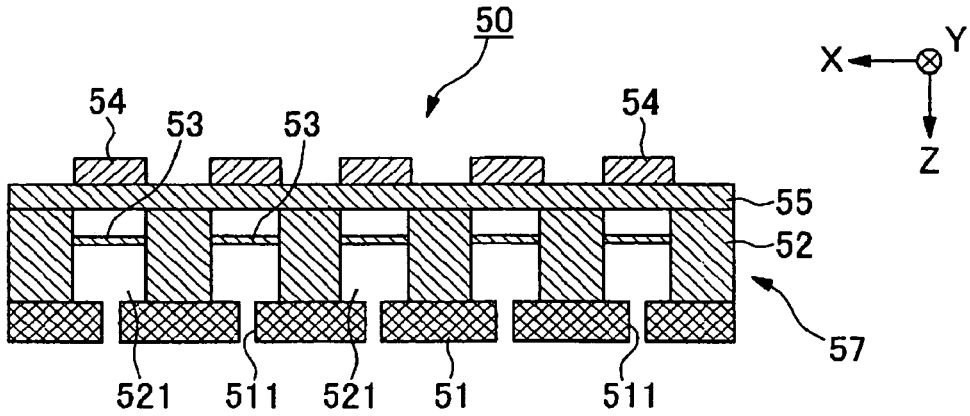
FIG. 3 is a side cross-sectional view of the ink jet head in accordance with the embodiment.

Next, a structure of the ink jet head shown in FIG. 1 is described. FIG. 2 is an exploded perspective view of the ink jet head, and FIG. 3 is a side cross-sectional view schematically showing the structure of the ink jet head taken along an X direction indicated in FIG. 2. It is noted that FIG. 2 shows a state of the head that is upside down with respect to the state in which it is mounted to the ink jet printer 60. In the following description, the ink jet recording head 50 may be simply referred to as the head 50.

The head 50, as shown in FIG. 2 and FIG. 3, is mainly equipped with a nozzle plate 51, a head main body 57, and piezoelectric elements (vibration sources) 54. The head main body 57 is equipped with an ink chamber substrate 52 that is pattern-formed in a predetermined plane configuration that defines and forms ink flow passages (reservoir and the like) and cavities 521, and a vibration plate 55 that is formed in one piece with the ink chamber substrate 52. As shown in FIG. 2, the head main body 57 is stored in a base substrate 56. It is noted that the head 50 forms an on-demand type piezoelectric jet head.

The nozzle plate 51 is formed from, for example, a stainless steel plate, a nickel plate or the like, and includes multiple nozzles (droplet discharge openings) 511 formed penetrating therein for jetting ink droplets. The pitch of the nozzles 511 may be appropriately set according to printing resolutions.

The ink chamber substrate 52 is fixedly bonded (affixed) to the nozzle plate 51. The ink chamber substrate 52 is formed by a manufacturing method in accordance with the present invention, and has a plurality of cavities (ink cavities) 521, a reservoir 523 that temporarily reserves ink that is supplied from an ink cartridge 631, and supply ports 524 that supply the ink from the reservoir 523 to the respective cavities 521, which are defined by side walls (partition walls) 522 thereof, the nozzle plate 51, and the vibration plate 53.

Each of the cavities 521 is disposed for each of the corresponding nozzles 511, as shown in FIG. 2, and has a volume that is varied by a resilient deformation of the vibration plate 55 to be described below, such that the volume change instantaneously raises the pressure inside the cavity 521 to thereby eject the ink from the nozzle 511. Further, inside the cavities 521 in accordance with the present embodiment, connection sections 53 (cross-beams) that extend in a direction along the short sides of the cavity (X direction in the illustration) as viewed in a plan view and connect side walls 522 and 522, in other words, a plurality of beam members 53 spanning between the side walls 522 and 522, are provided. The multiple (six in the illustration) beam members 53 are provided generally at equal intervals in a direction along the long sides of the cavity (Y direction in the illustration).

The average thickness of the ink chamber substrate 52, in other words, the thickness thereof including the cavities 521, is not particularly limited, but may preferably be about 10-1000 μm, and more preferably, about 100-500 μm. Also, the volume of the cavity 521 is not particularly limited, but may preferably be about 0.1-100 nL, and more preferably, 0.1-10 nL.

The vibration plate 55 is provided on the ink chamber substrate 52 on the opposite side of the nozzle plate 51, and a plurality of piezoelectric elements 54 are provided on the vibration plate 55 on the opposite side of the ink chamber substrate 52. The vibration plate 55 can include a buffer layer for promoting crystal growth of each of the composing layers in the piezoelectric element 54 to be described below in detail.

Also, a communication hole 531 that penetrates the vibration plate 55 in its thickness direction is formed, as shown in FIG. 2, in the vibration plate 53 at a predetermined position. Ink can be supplied from the ink cartridge 631 shown in FIG. 1 to the reservoir 523 through the communication hole 531.

As the constituting material of the head main body 57, for example, nickel and copper may be enumerated as suitable materials, and the side walls 522, beam members 53 and the vibration plate 55 can be composed of the same material. In this manner, by forming the constituting members of the head main body 57 from the same material, the head main body 57 can be integrally formed, and excellent durability can be obtained even when the cavities 524 that are extremely minute are formed, and its manufacture can be effectively conducted. However, they are not prevented from being composed of different kind of materials.

Each of the piezoelectric elements 54 is respectively formed by interposing a piezoelectric layer 5 between a lower electrode 4 and an upper electrode 6, as described above, and disposed in a position corresponding generally to a center portion of each of the cavities 521. It is noted that the structure of the piezoelectric element 54 is described in detail below in conjunction with a method for manufacturing an ink jet head.

Each of the piezoelectric elements 54 is electrically connected to a piezoelectric element driving circuit to be described below, and is composed to operate (vibrate, deform) based on signals of the piezoelectric element driving circuit. In other words, each of the piezoelectric elements 54 functions as a vibration source (head actuator), wherein the vibration plate 55 vibrates (flexes) by vibration (flexing) of the piezoelectric element 54, and functions to instantaneously increase the inner pressure of the cavity 521.

The base substrate 56 is composed of, for example, any one of various resin materials, any one of metal materials, or the like, and the ink chamber substrate 52 is affixed to and supported by the base substrate 56.

Ink Discharge Operation

Figure 4:
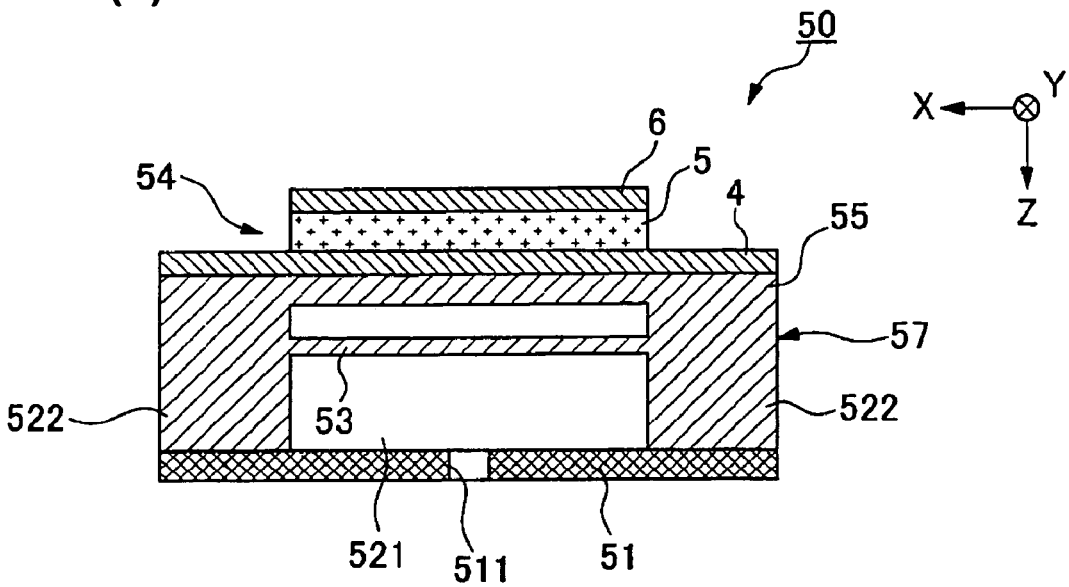
FIGS. 4(*a*) and (*b*) are views for describing operations of the ink jet head in accordance with the embodiment.
Figure 4:
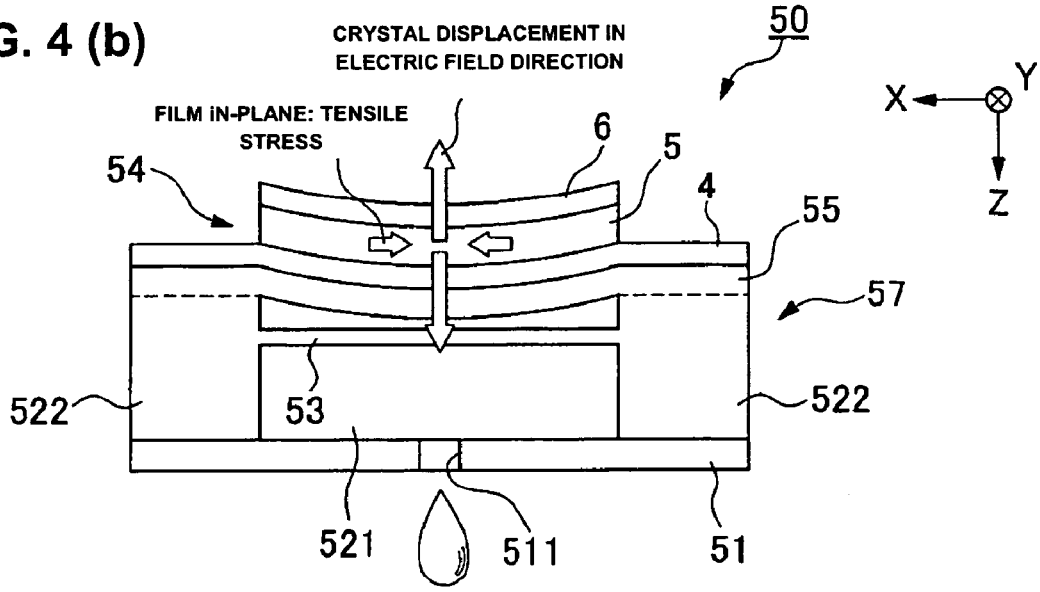

FIGS. 4(*a*)-(*b*) are partial cross-sectional views for describing operations of the head 50, wherein FIG. 4(*a*) indicates that the piezoelectric element 54 is in a state in which a voltage is not applied, and 4(*b*) indicates that the piezoelectric element 54 is in a state in which a voltage is applied. As indicated in FIG. 4(*a*), in a state in which a predetermined discharge signal is not inputted through the piezoelectric element driving circuit, in other words, in a state in which no voltage is applied across the lower electrode 4 and the upper electrode 6 of the piezoelectric element 54, no deformation occurs in the piezoelectric layer 5 of the head 50. For this reason, no deformation occurs in the vibration plate 55, and no volume change occurs in the cavity 521. Accordingly, no ink droplet is jetted from the nozzle 511.

On the other hand, as indicated in FIG. 4(*b*), in a state in which a predetermined discharge signal is inputted through the piezoelectric element driving circuit, in other words, in a state in which a predetermined voltage (for example, about 30V) is applied across the lower electrode 4 and the upper electrode 6 of the piezoelectric element 54, a deformation occurs in the piezoelectric film 5 in its minor axis direction. In this way, the vibration plate 55 is flexed by about 500 nm, for example, thereby causing a change in the volume of the cavity 521. At this moment, the pressure within the cavity 521 instantaneously increases, and an ink droplet is jetted from the nozzle 511.

In other words, when a voltage is applied, the crystal lattice of the piezoelectric layer 5 is extended in a direction perpendicular to its surface, and at the same time is compressed in a direction parallel with the surface. In this state, an in-plane tensile stress is working on the piezoelectric layer 5. Accordingly, this stress bends and flexes the vibration plate 55. The greater the displacement amount (in absolute terms) of the piezoelectric layer in the minor axis direction of the cavity 521, the greater the flexing amount of the vibration plate 55 becomes, such that an ink droplet can be more effectively jetted. It is noted here that "being effective" means that an ink droplet in the same amount can be jetted with less voltage. In other words, the driving circuit can be simplified, and at the same time the power consumption can be reduced, such that the pitch of the nozzles 511 can be formed at a higher density. Or, the length of the cavity 521 in its major axis direction (Y direction in the illustration) can be shortened, such that the overall size of the head can be made smaller.

Each time an ejection of ink is completed, the piezoelectric element driving circuit stops application of the voltage across the lower electrode 4 and the upper electrode 6. In this way, the piezoelectric element 54 returns generally to its original shape, such that the volume of the cavity 521 increases. It is noted that, at this moment, a pressure (pressure in a positive direction) works on the ink in a direction from the ink cartridge 631 to be described below toward the nozzle 511. For this reason, air is prevented from entering the cavity 521 from the nozzle 511, and an amount of ink matching with the discharged amount of ink is supplied from the ink cartridge 631 through the reservoir 523 to the cavity 521. In this manner, by inputting discharge signals successively through the piezoelectric element driving circuit to the piezoelectric elements 54 at positions where ink droplets are to be jetted, optional (desired) characters, figures and the like can be printed.

Furthermore, in the head 50 in accordance with the present embodiment, the beam members 53 span between the side walls 522, 522 in a manner to traverse the cavity 521 in its minor axis direction (X direction in the illustration), as shown in FIG. 4, such that, even when the vibration plate 55 is deformed by the piezoelectric element 54, the beam members 53 maintain the posture of the side walls 522, and the side walls 522 do not deform in a left-to-right direction (X direction in the illustration). Therefore, by the ink jet head 50 of the present embodiment, the adjacent cavities 521 are effectively prevented from changing their volumes due to vibrations of the piezoelectric element 54. In other words, even when the side walls 522 become thinner, as a result of the pitch of the nozzles 511 being narrowed and the cavities 521 being made smaller and narrower to achieve an even higher density and higher speed, the resultant prints would not have a deficiency, and printing with a high print quality can be performed at high speeds.

Method for Manufacturing Ink Jet Head

Head Main Body Manufacturing Step

Figure 5:
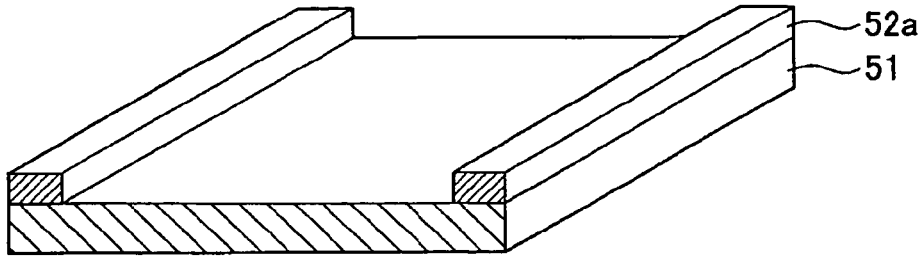
FIGS. 5(*a*)-(*d*) are perspective process drawings indicating steps of manufacturing a head main body in accordance with an embodiment.
Figure 5:
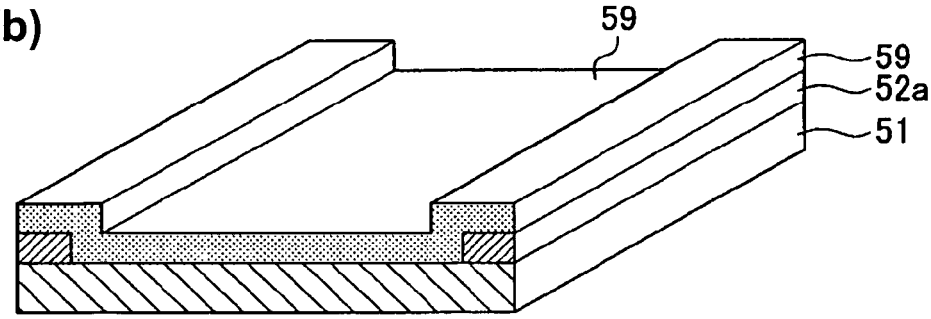
Figure 5:
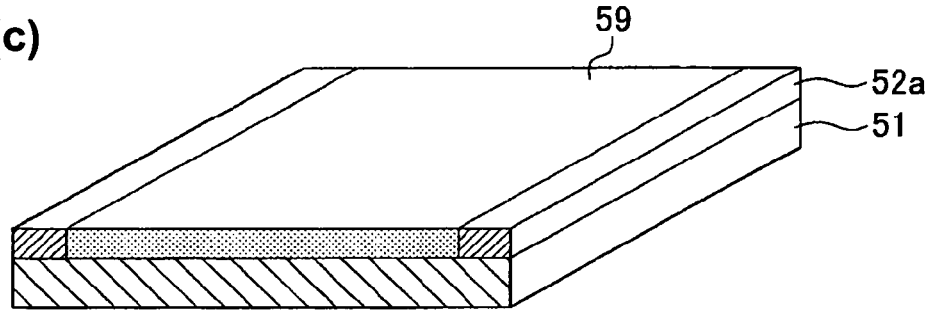
Figure 5:
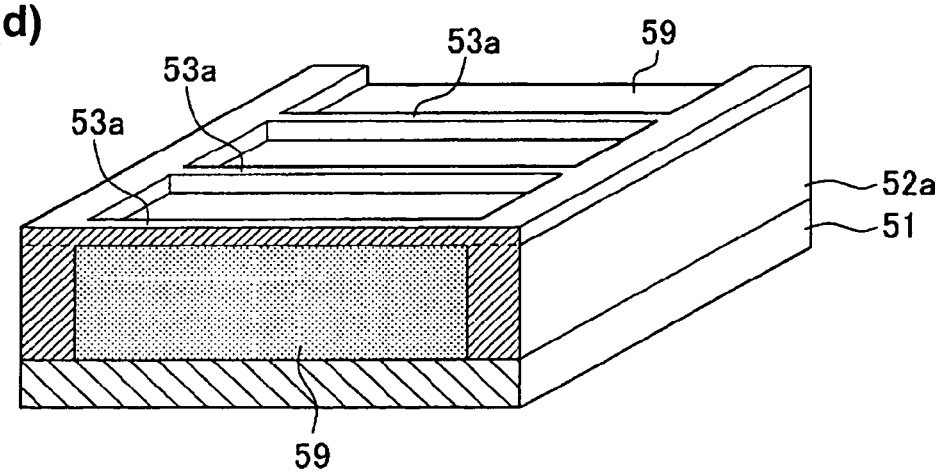

First, a method for manufacturing the head main body 57 of the ink jet head shown in FIG. 2 and FIG. 3 is described with reference to FIGS. 5 and 6. FIGS. 5(*a*)-(*d*) are perspective process drawings of a head main body in accordance with the present embodiment, and FIGS. 6(*a*)-(*c*) are perspective process drawings, which indicates steps succeeding the step shown in FIG. 5(*d*). It is noted that the description below is made with reference to a drawing corresponding to the head main body 57 showing only one cavity 521 in FIG. 4(*a*). However, in an actual manufacturing process, a plurality of cavities 521 are simultaneously formed in the head main body 57.

First, as shown in FIG. 5(*a*), a side wall material layer 52*a* in a predetermined plane configuration is formed on a base material 51. The side wall material layer 52*a* may be formed through forming a film of a metal material (first material), such as, for example, nickel, copper or the like by a sputter method or a vapor deposition method, and patterning the film by using a known photolithography technique. It is noted that, as the base material 51, a nozzle plate indicated in FIG. 2 can be used. When a nozzle plate of nickel or copper is used as the base material 51, a patterning process may be directly conducted on the surface of the base material in a predetermined plane configuration, to thereby form the first side wall material layer 52*a*.

Next, as shown in FIG. 5(*b*), a filling layer 59 composed of, for example, aluminum (second material) is formed by a sputter method or a vapor deposition method in a manner to cover the side wall material layer 52*a* and the base material 51, and the surface of the filling layer 59 is planarized by CMP (Chemical Mechanical Polishing) or the like, to expose an upper surface of the side wall material layer 52*a*, as shown in FIG. 5(*c*). The planarizing process may be conducted by a method other than CMP.

Thereafter, the step of patterning and forming the side wall material layer 52*a*, and the step of forming and planarizing the filling layer 59 are repeated, to obtain the side wall material layer 52*a* having a predetermined height and the filling layer 59 that is formed in the space therein. Then, as shown in FIG. 5(*d*), in a step in which the side wall material layer 52*a* at an uppermost surface is formed, a beam member layer 53*a* that traverses on the filling layer 59 is formed with the same material as that of the side wall material layer 52*a*. The beam member layer 53*a* is to compose beam members 53 shown in FIG. 4. Also, in this case, by changing the shape of the mask used for patterning the side wall material layer 52*a*, a layer including the beam member layer 53*a* can be readily formed.

It is noted that the beam member layer 53*a* can be formed by using a material different from that of the side wall material layer 52*a*, but may preferably be a material that can obtain a sufficient selection ratio with respect to the constituting material of the filling layer 59 (preferably, nickel, copper or the like) in order to selectively remove the filling layer 59 in a succeeding step.

Figure 6:
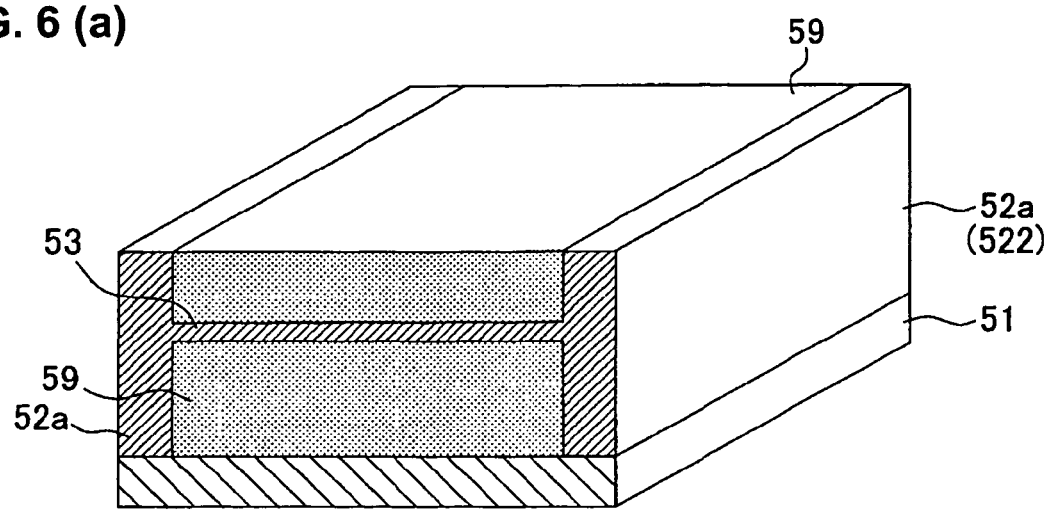
FIGS. 6(*a*)-(*c*) are perspective process drawings indicating steps of manufacturing the head main body in accordance with an embodiment.
Figure 6:
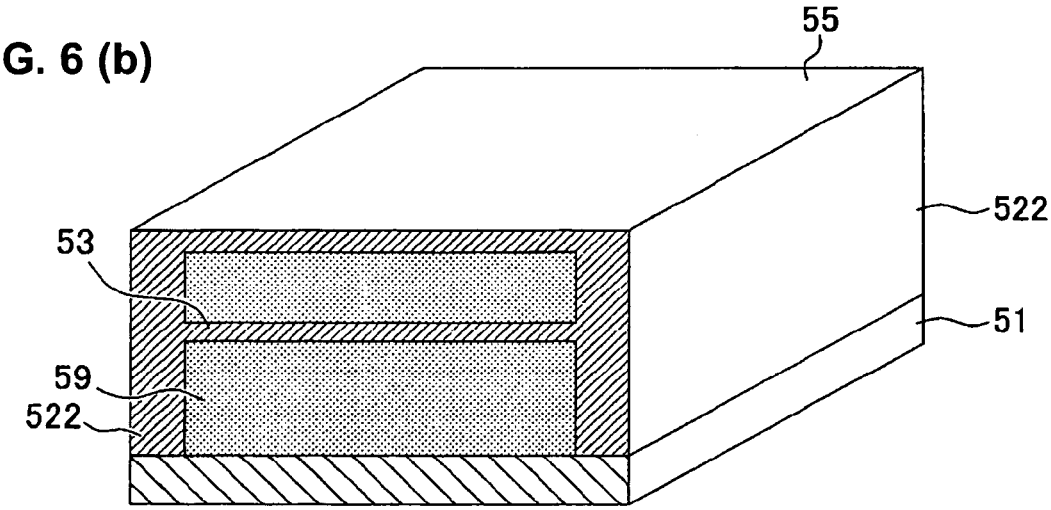
Figure 6:
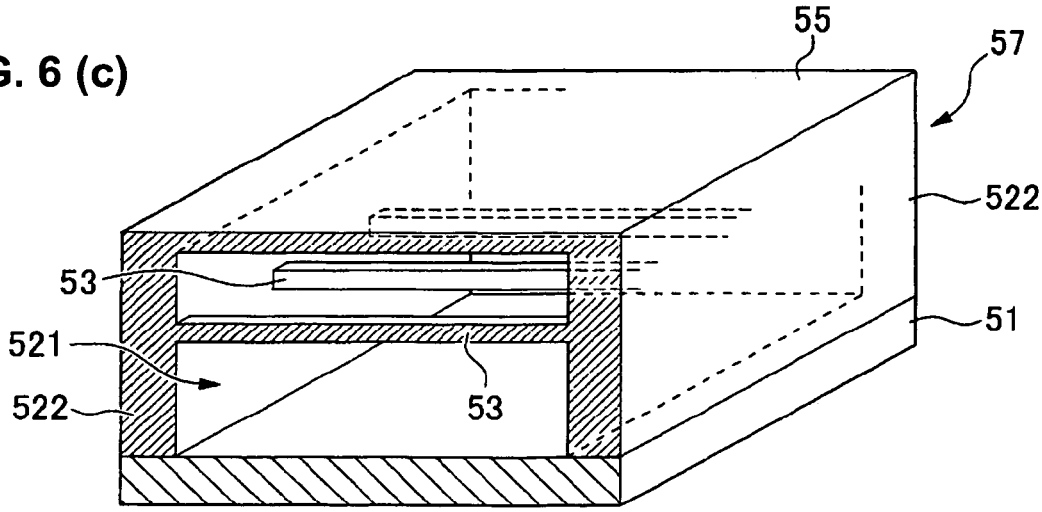

As shown in FIG. 5(*d*), when layers composed of the side wall material layer 52*a* and the beam member layer 53*a* are formed, the filling layer 59 is formed and planarized in the same manner as the preceding step, and then formation and planarization of the side wall material layer 52*a* and the filling layer 59 are further repeated until the side wall material layer 52*a* reaches a predetermined height (i.e., the height of the side walls 522), as shown in FIG. 6(*a*), thereby forming the side walls 522 on the base material 51.

Next, as shown in FIG. 6(*b*), a metal film composed of the same material as that of the side wall material layer 52*a* is formed in a manner to cover the side walls 522 and the filling layer 59, thereby forming a vibration plate 55 that is in one piece with the side walls 522. Then, by removing the filling layer 59 filled in an area surrounded by the side walls 522, the vibration plate 55 and the base material 51 by an etching process, the head main body 57 shown in FIG. 6(*c*) is obtained. For the etching process performed on the filling layer 59, an alkaline etching solution, such as, for example, a KOH solution, NaOH solution or the like may preferably be used, and a selection ratio between the filling layer 59 and the side walls 522, beam member 53 and vibration plate 55 can be adjusted depending on the concentration of the etching solution.

A piezoelectric element installation step is described below, and it is noted that the step of removing the filling layer 59 by an etching process may preferably be conducted after the piezoelectric element 54 has been bonded to the head main body 57. According to this manufacturing method, as compared to a case in which the head main body 57 and the piezoelectric element 54 are bonded after the cavity 521 defining an inner void has been formed, the bonding is facilitated, and deformations of the head main body 57 can be prevented, which contributes to an improvement of the manufacturing yield of ink jet heads.

Piezoelectric Element Installation Step

Next, steps of installing the piezoelectric elements 54 on the head main body 57 obtained by the aforementioned manufacturing steps are described with reference to FIGS. 7 and 8.

Structure of Piezoelectric Element

Figure 7:
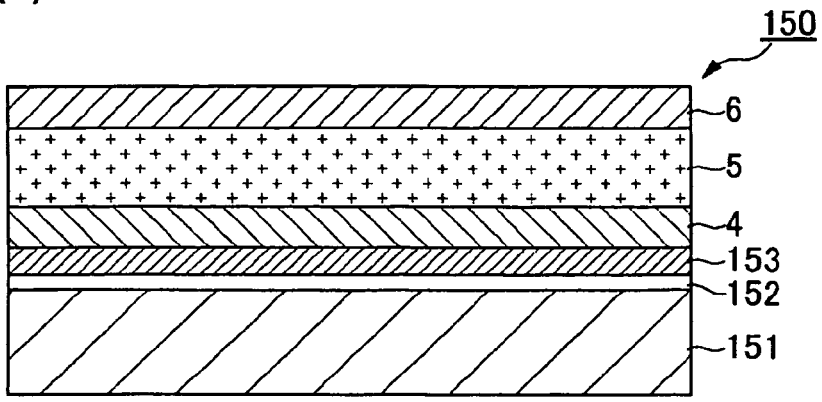
FIGS. 7(*a*)-(*c*) are perspective process drawings indicating steps of installing a piezoelectric element in accordance with an embodiment.
Figure 7:
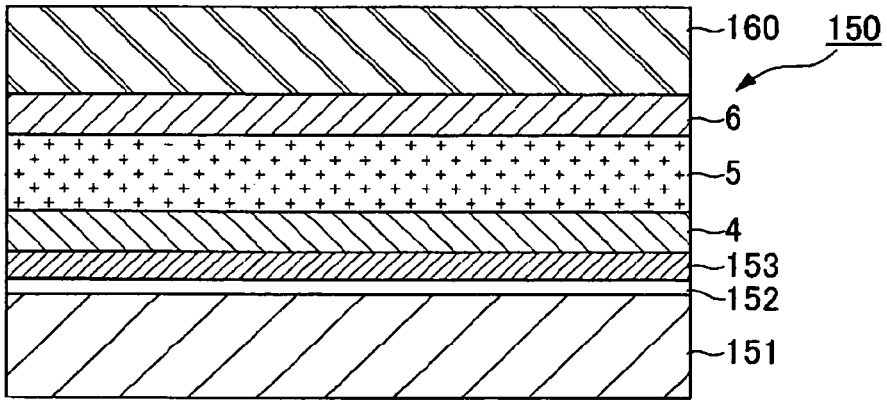
Figure 7:
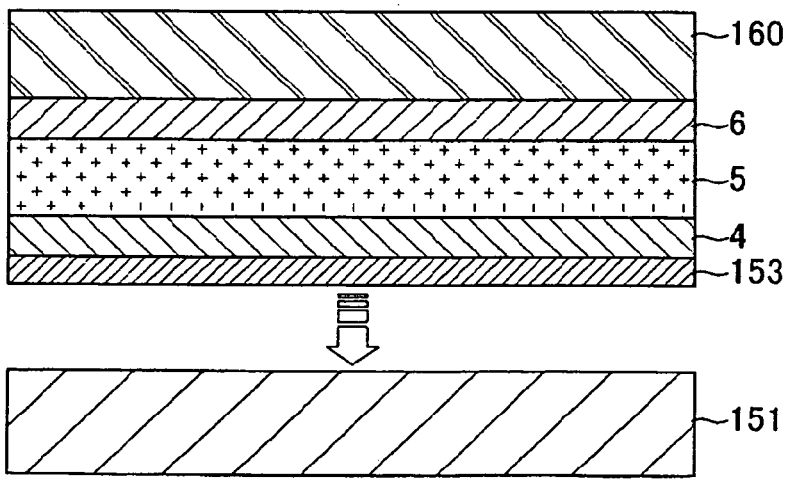

Prior to the description of the steps, first, a piezoelectric thin film element 150 shown in FIG. 7(*a*) is described. The piezoelectric thin film element 150 has a structure equipped with a Si (100) single crystal substrate 151, and a buffer layer (second buffer layer) 153, a lower electrode 4, a piezoelectric layer 5 and an upper electrode 6 successively formed and laminated through a sacrificial layer (first buffer layer) 152 on the single crystal substrate 151, wherein the upper side thereof from the buffer layer 153 is manufactured as the piezoelectric element 54 that can be installed on the head main body 57.

As the single crystal substrate 151, a single crystal silicon substrate with a (100) orientation, as well as a single crystal silicon substrate with a (111) orientation can be preferably used. However, without being limited to them, for example, a Si substrate with a (110) orientation with an amorphous silicon oxide film such as a thermal oxidation film or a natural oxidation film formed on a surface thereof can also be used.

The sacrificial layer 152 may preferably be formed from strontium oxide (SrO) with a (110) or (100) orientation, and more preferably, with a (110) orientation. The SrO is suitable for epitaxially growing the buffer layer 153 to the formed thereon as described below. It is noted here that the SrO is preferably be formed particularly through epitaxial growth. By forming it in this manner, the crystal lattice of the SrO with a (110) or (100) orientation is regularly aligned on the Si substrate with a (100) orientation, such that the buffer layer 153 can epitaxially grow well on the SrO. Also, for the sacrificial layer 152, BaO, MgO, CaO or the like can be used. Even when they are used, the buffer layer 153 can be epitaxially grown well.

As the buffer layer 153, a single layer or multiple layers of metal oxide can be used. As specific examples thereof, yttria stabilized zirconia (hereafter abbreviated as YSZ) with a (100) orientation, or a structure having a first layer of $ZrO_2$, a second layer of $CeO_2$ with a (100) orientation, and a third layer of $YBa_2Cu_3O_x$ with a (001) orientation successively laminated in this order may be preferred. With the buffer layer 153 having such a three-layer structure, YSZ ($ZrO_2$) epitaxially grows well in a (100) orientation on the sacrificial layer 152, $CeO_2$ epitaxially grows well in a (100) orientation thereon, and further $YBa_2Cu_3Ox$ epitaxially grows well in a (001) orientation thereon. Accordingly, even when the three-layer structure is used, the lower electrode 4 having a perovskite structure with a (100) orientation to be described below is formed well on the buffer layer 153.

The lower electrode 4 defines one of electrodes for applying a voltage to the piezoelectric layer 5. When a plurality of piezoelectric elements 54 are provided on the head main body 57 of the ink jet head, as shown in FIG. 3, the lower electrode 4 can be formed generally in the same size as that of the external surface of the vibration plate 57 as a common electrode, or may be formed generally in the same configuration as the piezoelectric layer 5 and the upper electrode 6 to be described below.

The lower electrode 4 may preferably be formed from at least one type selected from metal oxides having a perovskite structure with a psuedo-cubic (100) orientation, more specifically, $SrRuO_3$, $CaRuO_3$, $BaRuO_3$, $SrVO_3$, (La, Sr) $MnO_3$, (La, Sr) $CrO_3$, and (La, Sr) $CoO_3$, and the like. Furthermore, as the lower electrode 4, Pt, Ir or a laminated structure of these metals can also be used. These metals can be epitaxially grown well on the buffer layer 53.

Strontium ruthenate (SRO) has a perovskite structure shown by $Sr_{n+1}Ru_nO_{3n+1}$ (n is an integer of 1 or greater). With this structure, when n=1, it becomes to be $Sr_2RuO_4$, when n=2, it becomes to be $Sr_3Ru_2O_7$, and when n=∞, it becomes to be $SrRuO_3$. When SRO is used as the lower electrode 4, $SrRuO_3$ may be most preferred in order to increase the conductivity and crystallinity of the piezoelectric layer 5.

Also, as the lower electrode 4, instead of a single layer of metal oxide, for example, a laminated structure including two layers of metal oxide and Ir or Pt interposed between them can also be used. In this case, as the metal oxide, for example, SRO (strontium ruthenate) can be used, and in the case of such a structure, the SRO on the side of the piezoelectric layer 5 may preferably be composed of $SrRuO_3$.

The piezoelectric layer 5 is composed of a piezoelectric ceramic having a perovskite crystal structure and including volatile elements formed in a predetermined configuration on the lower electrode 4. More specifically, it may be formed from lead zirconate titanate (Pb(Zr, Ti) $O_3$: PZT), lead lanthanum titanate (Pb(La) $TiO_3$), lead lanthanum zirconate ((Pb, La) $ZrO_3$: PLZT), lead magnesium niobate titanate (Pb (Mg, Nb) $TiO_3$: PMN-PT), lead magnesium niobate zirconate titanate (Pb (Mg, Nb) (Zr, Ti) $O_3$: PMN-PZT), lead zinc niobate titanate (Pb (Zn, Nb) $TiO_3$: PZN-PT), lead scandium niobate titanate (Pb (Sc, Nb) $TiO_3$: PSN-PT), lead nickel niobate titanate (Pb (Ni, Nb) $TiO_3$: PNN-PT), $Bi_4Ti_3O_{12}$, $SrBi_2Ta_2O_9$ or the like.

The piezoelectric layer 5 can be formed by any one of vapor phase film forming methods such as a laser ablation method, or liquid phase film forming methods such as a droplet jetting method, a sol-gel method or the like. For example, in the case of the sol-gel method, a precursor compound (metal alkoxide) of constituting materials of the piezoelectric layer 5 is formed into a film on the substrate, and the substrate on which the film of the precursor compound is formed is heat-treated under normal pressure or under pressure with the presence of oxygen, thereby changing the precursor compound to a ferroelectric thin film.

The upper electrode 6 defines the other electrode for applying a voltage to the piezoelectric layer 4, and is formed from a material having conductivity, such as, for example, platinum (Pt), iridium (Ir), aluminum (Al) or the like, or other materials can also be used. When aluminum is used as the upper electrode 6, iridium or the like is laminated thereon as a countermeasure against electrocorrosion.

It is noted that, in the above description, a case in which SrO is used as the sacrificial layer 152 is described. However, a structure in which the buffer layer 153 with a three-layer structure formed on the upper side thereof is directly formed on the single crystal substrate 151 can also be applied. In this case, the structure is formed from the layers composed of YSZ, $CeO_2$, $YBa_2Cu_3O_x$, respectively, laminated on the single crystal substrate 151, and the lower electrode 4 is formed on the $YBa_2Cu_3O_x$ layer. With this structure, the $YBa_2Cu_3O_x$ layer functions as a sacrificial layer. When the $YBa_2Cu_3O_x$ layer is used as a sacrificial layer, its film thickness may preferably be 100 nm or greater. On the other hand, when the sacrificial layer 152 composed of SrO or the like is provided as described above, the film thickness of the $YBa_2Cu_3O_x$ layer may preferably be less than 100 nm.

Installation Step

Next, steps of installing the piezoelectric elements 54 on the head main body 57 of the ink jet head 50 by using the piezoelectric thin film element 150 indicated in FIG. 7(*a*) are described.

When the piezoelectric thin film element 150 is prepared, a transfer base material 160 is adhered onto the upper electrode 6, as shown in FIG. 7(*b*). As the transfer base material 160, a resin film having one surface coated with a UV setting type or thermosetting type adhesive material can be enumerated, and it may preferably be equipped with a film that is transparent and flexible. Alternatively, a glass plate may be used instead of a resin film. The glass plate is inexpensive, retains its shape, and has light transmittance, such that, if one of its surfaces is coated with an adhesive, it can become a suitable transfer base material. The adhesive may preferably be quipped with a property that can be readily peeled off (thermal melting property) in a later step. Also, it may preferably have light transmittance, so as to facilitate positioning (alignment) at the time of bonding the piezoelectric elements to the head main body 57 in a later step.

Next, as shown in FIG. 7(*c*), the sacrificial layer 152 is removed by etching or the like, whereby the piezoelectric element (the buffer layer 153—the upper electrode 6) and the transfer base material 160 are separated from the single crystal substrate 151. For the etching process, an etching solution in which, for example, nitric acid is diluted with water can be used. Etching rates of SrO, MgO, BaO and CaO composing the sacrificial layer 152 are extremely high against acids, and they can be readily removed. Accordingly, in order to protect the piezoelectric element, an acidic solution with a low concentration may preferably be used as the etching solution. Also, it would be even better if a protection film is formed on the surface of the piezoelectric element in order to prevent damages by the etching.

It is noted that the single crystal substrate 151 separated in this step can be re-used in manufacturing the piezoelectric thin film element 150.

Figure 8:
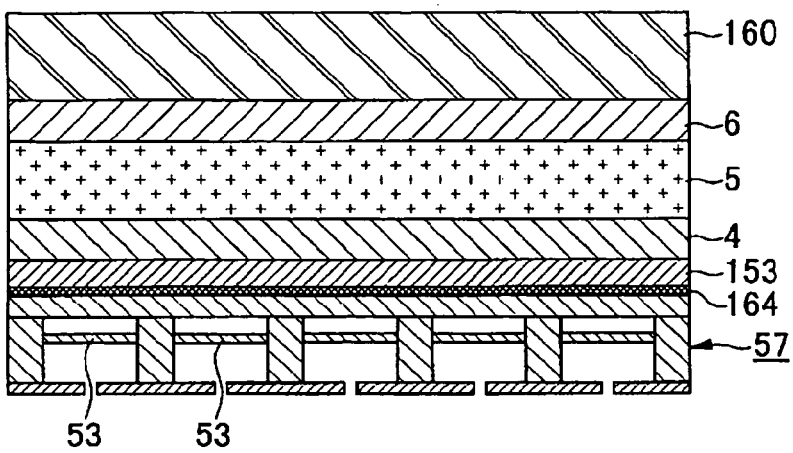
FIGS. 8(*a*)-(*c*) are perspective process drawings indicating steps of installing the piezoelectric element in accordance with an embodiment.
Figure 8:
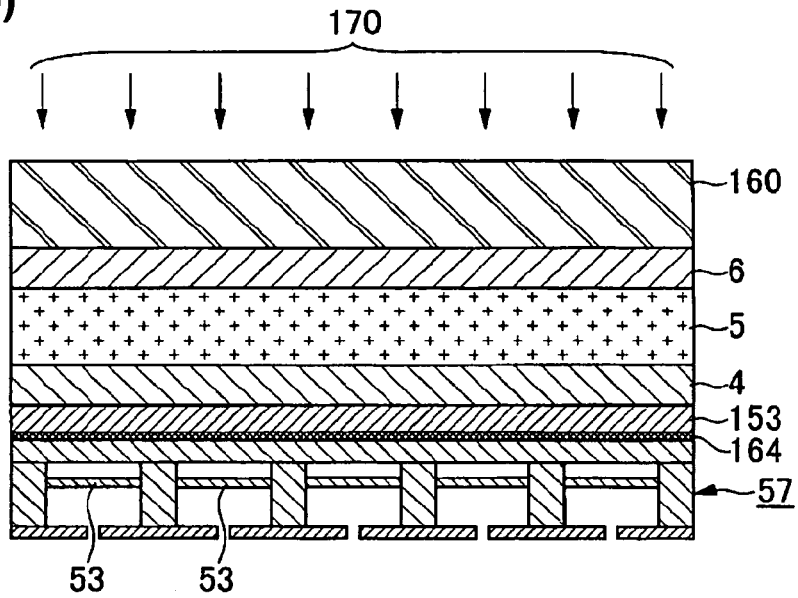
Figure 8:
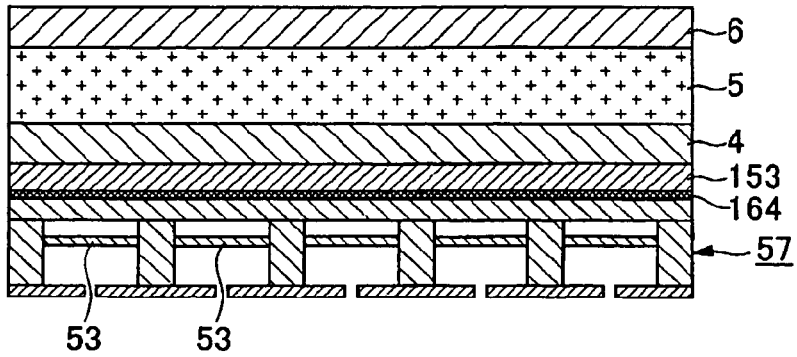
Figure 9:
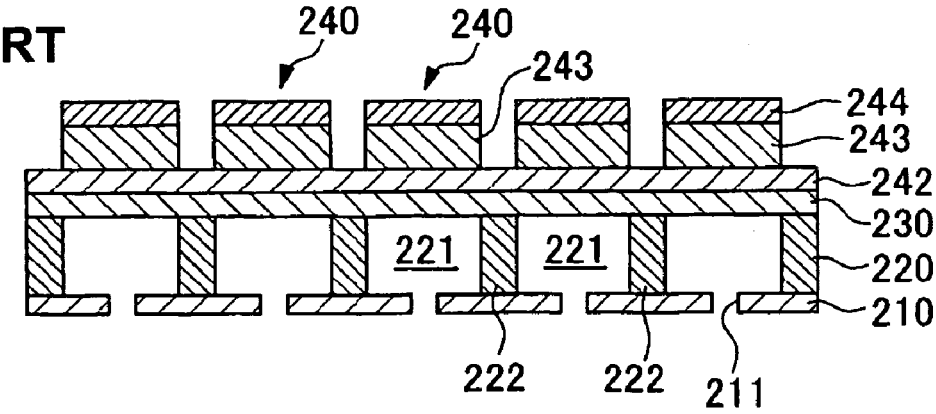
FIG. 9 PRIOR ART
FIG. 9 is a cross-sectional view of a structure of a conventional ink jet head.

Next, as shown in FIG. 8(*a*), the piezoelectric element retained on the transfer base material 160 is bonded to the head main body 57 through an adhesive layer 164. As the adhesive layer 164, a thermosetting type adhesive, a light-setting type adhesive such as a UV (ultraviolet light) setting type adhesive, or a reactive setting type adhesive may appropriately be used, but it may preferably have a property different from that of the adhesive that bonds the transfer base material 160 and the upper electrode 6. The adhesive layer 164 may be formed by, for example, a coating method. It is noted that, depending on the configuration of the sacrificial layer in the preceding step, the lower electrode 4 and the head main body 57 may be bonded together, and therefore the adhesive layer 164 may be formed on the outside surface side of the lower electrode 4.

Next, as shown in FIG. 8(*b*), ultraviolet light is irradiated from the side of the transfer base material 160 to the bonding surface between the upper electrode 6 and the transfer base material 160 to eliminate the bonding force, thereby separating the transfer base material 160 from the upper electrode 6. In this manner, when the adhesive coated on the transfer base material 160 is a UV setting type adhesive, the transfer base material 160 can be readily separated only by light irradiation. When a thermosetting type adhesive is used, heating may be conducted from the side of the transfer base material 160.

Through the steps described above, as shown in FIG. 8(*c*), the head main body 57 and the piezoelectric element can be bonded together. It is noted that, although omitted here, the upper electrode 6, the piezoelectric layer 5 and the lower electrode 4 are patterned after they have been transferred. By using the manufacturing method in which the piezoelectric elements are installed by such a transfer, the piezoelectric element with each layer thereof being epitaxially grown using the single crystal substrate 151 can be readily bonded to the head main body 57, and an ink jet head equipped with high performance piezoelectric elements can be readily manufactured. Also, by using this manufacturing method, materials for the head main body 57 can be optionally selected, such that an ink jet head having sufficient strength and durability can be manufactured even when the cavities 521 are made narrower and smaller for miniaturizing the head. Also, the buffer layer 153 can function as a vibration plate.

What is claimed is:

1. An ink jet head comprising:

a piezoelectric element; and a plurality of cavities, each cavity provided below the piezoelectric element and having a volume that changes by a deformation of the piezoelectric element;

wherein each cavity is provided with beam members that connect inner walls of the cavity; and wherein the beam members and the inner walls of the cavity where the beam members are installed both comprise a metal material.

2. The ink jet head according to claim 1, wherein:

each cavity comprises a space that is surrounded by a nozzle plate having a droplet discharge opening, a plurality of side walls extending from the nozzle plate and a vibration plate disposed opposite to the nozzle plate; and the beam members span between the side walls disposed mutually opposite to each other.

3. The ink jet head according to claim 2, wherein each cavity has a generally rectangular shape in a plan view, and the beam members span between the side walls opposing in a direction along short sides of the cavity.

4. The ink jet head according to claim 2, wherein the plurality of beam members are arranged in parallel with one another in a direction of long sides of the cavity in a plan view.

5. The ink jet head according to claim 2, wherein the beam members and the inner walls of the cavity where the beam members are installed comprise an identical material.

6. The ink jet head according to claim 2, wherein the side walls and the vibration plate comprise an identical material.

7. An ink jet printer comprising the ink jet head recited in claim 1.

* * * * *